US011315497B2

(12) United States Patent
Yu et al.

(10) Patent No.: US 11,315,497 B2
(45) Date of Patent: Apr. 26, 2022

(54) GATE DRIVING CIRCUIT AND IMAGE DISPLAY DEVICE INCLUDING IHE SAME

(71) Applicant: LG Display Co., Ltd., Seoul (KR)

(72) Inventors: Jaesung Yu, Seoul (KR); Chungsik Kong, Paju-si (KR); Sewan Lee, Seoul (KR); Juhnsuk Yoo, Seoul (KR); Jungsoo Park, Goyang-si (KR); Mihee Shin, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/943,579

(22) Filed: Jul. 30, 2020

(65) Prior Publication Data

US 2021/0201808 A1 Jul. 1, 2021

(30) Foreign Application Priority Data

Dec. 30, 2019 (KR) ..... 10-2019-0178069

(51) Int. Cl.

| | |
|---|---|
| ***G09G 3/3266*** | (2016.01) |
| ***G09G 3/20*** | (2006.01) |
| ***G09G 3/3225*** | (2016.01) |
| ***G09G 3/3275*** | (2016.01) |
| ***G09G 3/36*** | (2006.01) |

(52) U.S. Cl.

CPC ..... *G09G 3/3266* (2013.01); *G09G 3/2003* (2013.01); *G09G 3/3225* (2013.01); *G09G 3/3275* (2013.01); *G09G 2310/0202* (2013.01); *G09G 2310/0251* (2013.01); *G09G 2310/08* (2013.01)

(58) Field of Classification Search

CPC .. G09G 3/3266; G09G 3/3225; G09G 3/2003; G09G 3/3275; G09G 2310/0202; G09G 2310/0251; G09G 2310/08

See application file for complete search history.

(56) References Cited

U.S. PATENT DOCUMENTS

2003/0038766 A1* 2/2003 Lee ..... G09G 3/3648 345/87
2006/0279492 A1* 12/2006 Chen ..... G09G 3/3216 345/77

(Continued)

FOREIGN PATENT DOCUMENTS

CN 107045858 A 8/2017
KR 20060079037 A 7/2006

(Continued)

*Primary Examiner* — David Tung
(74) *Attorney, Agent, or Firm* — Seed IP Law Group LLP

(57) ABSTRACT

A gate driving circuit and an image display device including the gate driving circuit are provided. In some embodiments of the present disclosure, the gate driving circuit includes a plurality of stages configured to sequentially and repeatedly output a plurality of scan pulses having different pulse widths in response to a gate control signal applied from a timing controller and the plurality of stages sequentially generate the plurality of scan pulses having different pulse widths and phase-delayed in response to three-phase clock pulses among the gate control signals and sequentially supply the plurality of scan pulses to gate lines of a display panel to selectively adjust a light emission period or a color display period for each red pixel, green pixel, and blue pixel, thereby improving image quality.

15 Claims, 7 Drawing Sheets

(56) References Cited

U.S. PATENT DOCUMENTS

| | | | | |
|---|---|---|---|---|
| 2010/0315403 | A1* | 12/2010 | Kaneyoshi | G09G 3/3677 345/211 |
| 2016/0125783 | A1* | 5/2016 | Huang | G09G 3/2003 345/694 |
| 2016/0335947 | A1* | 11/2016 | Wu | G09G 3/3614 |
| 2018/0240382 | A1* | 8/2018 | Choi | G09G 3/003 |
| 2019/0333457 | A1* | 10/2019 | Liu | G09G 3/3607 |

FOREIGN PATENT DOCUMENTS

| | | | |
|---|---|---|---|
| KR | 20110104320 | A | 9/2011 |
| KR | 20170102148 | A | 9/2017 |

* cited by examiner

GATE DRIVING CIRCUIT AND IMAGE DISPLAY DEVICE INCLUDING IHE SAME

CROSS-REFERENCE TO RELATED APPLICATION

This application claims priority to and the benefit of Korean Patent Application No. 10-2019-0178069, filed Dec. 30, 2019, the disclosure of which is incorporated herein by reference in its entirety.

BACKGROUND

Technical Field

The present disclosure relates to a gate driving circuit capable of selectively adjusting a light emission period or a color display period of each pixel to improve image quality, and one particular embodiment relates to an image display device including the gate driving circuit.

Description of Related Art

Image display devices may be used in various types of electronic products, such as mobile phones, tablet PCs, laptops, vehicles, and billboards. Examples of the image display devices may include liquid crystal display devices, organic light emitting diode (OLED) display devices, electro-wetting display devices, and field emission devices.

Liquid crystal display devices or OLED display devices may include an image display panel with a plurality of matrix pixels and configured to adjust light transmissivity of or an amount of light emitted from pixels and to display an image. Panel driving circuits may be mounted on or electrically connected to the image display panel to drive the pixels of the image display panel.

For example, the OLED display panel may include a plurality of gate lines and a plurality of data lines intersecting each other and each of pixel areas defined with intersecting gate lines and data lines may include pixels with the OLED.

A panel driving circuit configured to drive the display panel may include a gate driving circuit to sequentially drive the gate lines, a data driving circuit to supply data voltages to the data lines, and a timing controller to supply a gate control signal used to control a driving timing of the gate driving circuit and a data control signal used to control a driving timing of the data driving circuit.

The gate driving circuit may sequentially supply scan pulses to the gate lines to drive the pixels of the image display panel in gate line sequence. In this case, the data driving circuit may supply data voltages to the data lines when the scan pulses are supplied to the gate lines in gate line sequence. Therefore, the OLED display panels may adjust the amount of light emitted by the OLED for each pixel based on the data voltage and to display an image.

BRIEF SUMMARY

Pixels may be driven to increase a charging rate of image data voltage charged in each of the pixels or to increase a light emission period or a color display period such that quality of the image displayed on an image display device is improved.

As every frame period may be limited according to sizes or driving characteristics of an image display panel, there is a limitation in extending an image data voltage charging period or a light emission period of each of the pixels.

According to an embodiment of the present disclosure, problems to be solved are to provide a gate driving circuit to selectively adjust the image data voltage charging period of each of the pixels and to adjust the charging rate of image data voltage charged in and a color display period of each of the pixels and an image display device including the gate driving circuit.

The present disclosure further provides the gate driving circuit to increase a data charging rate of green pixels having a greatest grayscale voltage difference or selectively increase a data charging rate of blue pixels having a greatest value of image data voltage, among red pixels, green pixels, and blue pixels, to improve image display quality, and an image display device including the gate driving circuit.

The problems in the present disclosure are not limited to the problems mentioned above and other problems not mentioned can be clearly understood by those skilled in the art from the following description.

According to an embodiment of the present disclosure, the gate driving circuit may include a plurality of stages to sequentially and repeatedly output a plurality of scan pulse signals with different pulse widths in response to an external gate control signal. The plurality of stages may sequentially generate a plurality of scan pulses having different pulse widths and phase-delayed in response to three-phase clock pulses of the gate control signal and sequentially supply the plurality of scan pulses to gate lines of the display panel. When the gate lines of the display panel are sequentially driven based on the plurality of scan pulses having the different pulse widths and phase-delayed, the voltage charging period of the image data may be changed for each red pixel, green pixel, and blue pixel.

In some examples, the second clock pulse has a pulse width wider than a pulse width of a first clock pulse and a third clock pulse has a pulse width wider than the pulse width of the second clock pulse, among the three-phase clock pulses, such that the first clock pulse to the third clock pulse are sequentially and alternatively supplied to the plurality of stages.

In some examples, the third clock pulse among the three-phase clock pulses has a pulse width wider than the pulse width of the first clock pulse and the second clock pulse among the three-phase clock pulses has the pulse width wider than the pulse width of the third clock pulse such that the first clock pulse to the third clock pulse are sequentially and alternatively supplied to the plurality of stages.

At least one (3n−2)th stage among the plurality of stages may supply a first scan pulse to red sub-pixels of the display panel in response to the first clock pulse and at least one (3n−1)th stage may supply a second scan pulse to green sub-pixels of the display panel in response to the second clock pulse. In addition, at least one (3n)th stage may supply a third scan pulse to blue sub-pixels of the display panel in response to the third clock pulse. "n" may be a natural number except 0.

Details of other embodiments are included in the detailed description and drawings.

According to an embodiment of the present disclosure, the gate driving circuit and the image display device including the gate driving circuit may selectively adjust a voltage charging period of image data for red pixels, green pixels, and blue pixels to adjust a charging rate of image data voltage charged in and the color display period of each red pixel, green pixel, and blue pixel.

In addition, the gate driving circuit and the image display device including the gate driving circuit may selectively increase the data charging rate of the green pixels having a greatest grayscale voltage difference and increase the data charging rate of the blue pixels having a greatest value of image data voltage, among the red pixels, the green pixels, and the blue pixels, to improve image display quality.

As the disclosure set forth herein described in Technical Problem, Technical Solution, and Effects does not specify features of claims, the scope of claims is not limited to the disclosure described herein.

DETAILED DESCRIPTION

Figure 1:
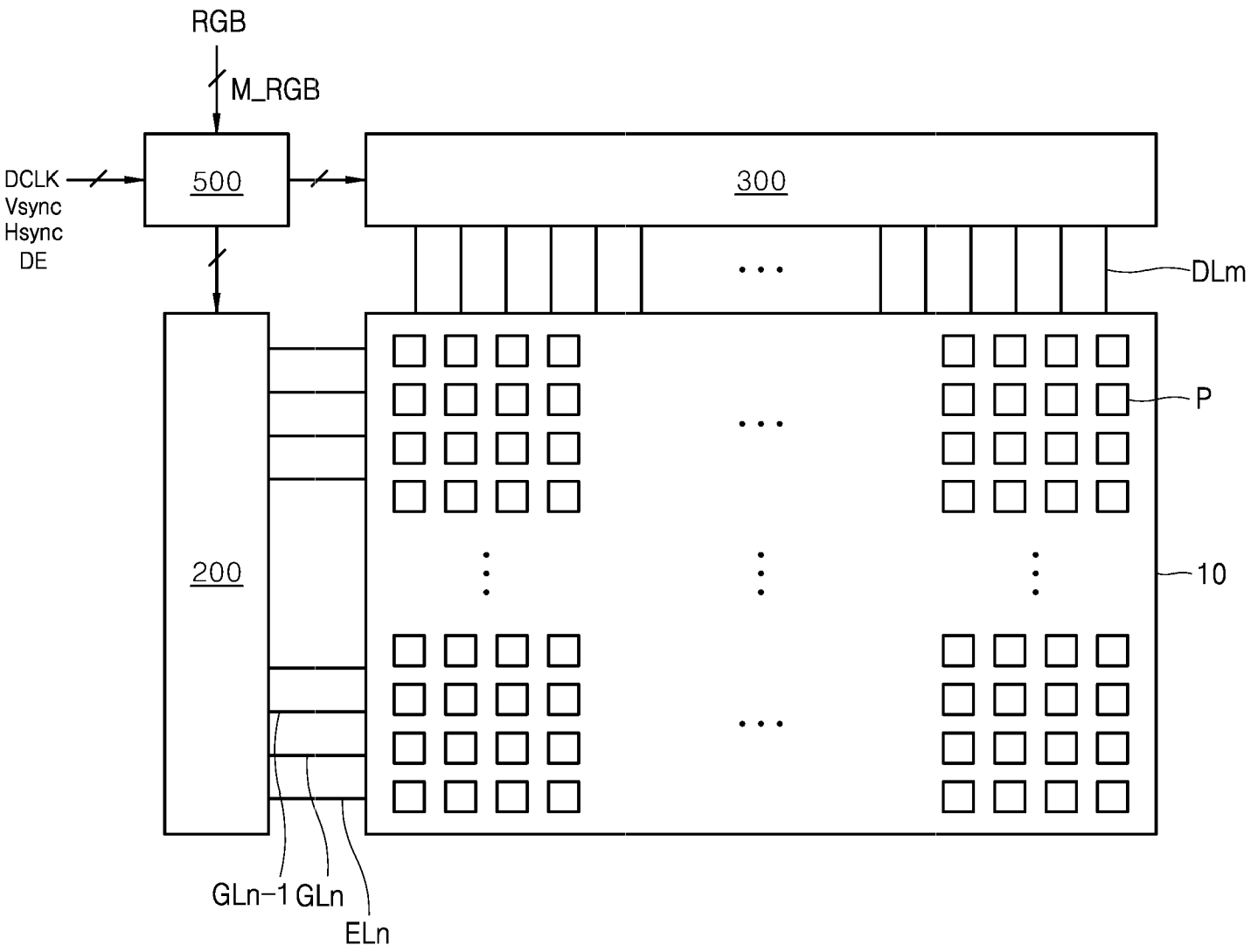
FIG. 1 is a configuration diagram showing an example image display device including a gate driving circuit according to one or more embodiments of the present disclosure.

Some embodiments of the present disclosure and methods for achieving them will be apparent from the accompanying drawings and exemplary embodiments described below in detail. However, the present disclosure is not limited to the embodiments disclosed below, but is implemented in various different manners. Rather, these embodiments are provided so that this disclosure will be thorough and complete, and will fully convey the scope of the disclosure to those skilled in the art and the present disclosure is only defined by the scope of the claims.

Shapes, sizes, ratios, angles, numbers, and the like shown in the accompanying drawings for describing embodiments of the present disclosure are merely examples, and the present disclosure is not limited thereto. Like reference numerals denote like elements throughout the present disclosure. Further, in the following description, a detailed explanation of a well-known technology relating to the present disclosure may be omitted if it unnecessarily obscures the gist of the present disclosure. The terms such as "including," "having," and "consist of" used herein are generally intended to allow other components to be added unless the terms are used with the term "only." The singular forms are intended to include the plural forms as well, unless the context clearly indicates otherwise.

In analyzing components, it is interpreted as including an error range even if there is no explicit description. When a position relation between two components is described using terms such as "on," "above," "below," "next to," and the like, one or more components may be disposed between the two components unless the term 'immediately' or 'directly' is used.

When temporal relations are described using terms such as "after," "subsequent to," "next," "before," and the like, these terms may include discontinuous case unless the term 'immediately' or 'directly' is used.

Features of example embodiments of the present disclosure can be partially or entirely combined with each other, can be used technically in association with each other, and driven, and embodiments can be independently implemented or may be implemented together in an association relation.

A gate driving circuit and an image display device including the gate driving circuit according to an embodiment of the present disclosure are described below with reference to the accompanying drawings. An example of the image display device may include an organic light emitting diode (OLED) display device, but is not limited thereto.

FIG. 1 is a configuration diagram showing an example image display device including a gate driving circuit according to one or more embodiments of the present disclosure.

An OLED display device shown in FIG. 1 includes a display panel 10, a gate driving circuit 200, a data driving circuit 300, and a timing controller 500. The display panel 10 may include the gate driving circuit 200, the data driving circuit 300 and/or the timing controller 500.

The display panel 10 includes, in pixel areas, a plurality of sub-pixels (P) R, G, and B or a plurality of sub pixels (P) R, G, B, and W in matrix configurations to display an image. The display panel 10 includes the sub-pixels P to implement a triple rate driving (TRD) display panel 10 (hereinafter; "TRD" display panel).

Each sub-pixel P includes an OLED and a pixel circuit to independently drive the light emitting diode. Each pixel circuit portion is driven to supply a driving voltage corresponding to an image data voltage (e.g., an analog image voltage) applied through data lines DL1 to DLm connected thereto and charge the analog image data voltage to maintain a light emitting state.

The timing controller 500 aligns the external input image data RGB based on driving properties such as resolution and driving frequencies of the display panel 10 and transmits the aligned image data RGB to the data driving circuit 300. In this case, the timing controller 500 arranges sensing data and image data for sub-pixel units in each horizontal line such that sensing data voltage corresponding to the sensing data and image data voltage corresponding to the image data are sequentially supplied to each of the sub-pixels in each horizontal line unit. The timing controller 500 aligns the sensing data and the image data for each red sub-pixel, green sub-pixel, and blue sub-pixel in horizontal line units and transmits the aligned sensing data and image data to the data driving circuit 300.

The timing controller 500 also generates a gate control signal based on external input synchronization signals DCLK, Vsync, Hsync, and DE and supplies the generated gate control signal to the gate driving circuit 200 to control a driving timing of the gate driving circuit 200 and the timing controller 500 generates a data control signal based on the external input synchronization signals DCLK, Vsync, Hsync, and DE and supplies the generated data control signal to the data driving circuit 300 to control a driving timing of the data driving circuit 300.

In particular, the timing controller 500 generates and outputs a plurality of gate shift clocks with different pulse widths to supply the plurality of generated gate shift clocks to the gate driving circuit 200 such that the charging rate of the image data voltage and the color display period may be selectively adjusted for each red sub-pixel, green sub-pixel, and blue sub-pixel. In some examples, the timing controller 500 sequentially and repeatedly generates a plurality of clock pulses with the different pulse widths and supplies, to the gate driving circuit 200, the plurality of clock pulses having the different pulse widths and repeatedly generated, as the plurality of gate shift clocks.

The gate driving circuit 200 sequentially and repeatedly generates the plurality of scan pulses having the different pulse widths in response to the gate control signal applied from the timing controller 500, for example, at least one gate start pulse and a plurality of gate shift clocks including a plurality of clock pulses having the different pulse widths and sequentially and repeatedly supplies scan pulses to gate lines GL1 to GLn of the image display device. The image data voltage charging period and the charging rate of the image data voltage may be changed for each red sub-pixel, green sub-pixel, and blue sub-pixel based on the plurality of scan pulses having the different pulse widths and sequentially and repeatedly generated.

The gate driving circuit 200 also sequentially generates a plurality of light emission control signals in response to the gate start pulse and the plurality of gate shift clocks and sequentially supplies each of the light emission control signals to each of light emission control lines EL1 to ELn.

The data driving circuit 300 uses a source start pulse and a source shift clock among the data control signals applied from the timing controller 500 to latch the sensing data and the image data in horizontal line units, where the sensing data and the image data are each aligned by the timing controller 500. For example, the data driving circuit 300 latches and converts the sensing data voltage and the image data voltage such that the sensing data voltage corresponding to the sensing data and the image data voltage corresponding to the image data are sequentially supplied to each of the sub-pixels in horizontal line units. The data driving circuit 300 supplies the sensing data voltage and the image data voltage to the data lines DL1 to DLm in horizontal line units in response to a source output enable signal.

Figure 2:
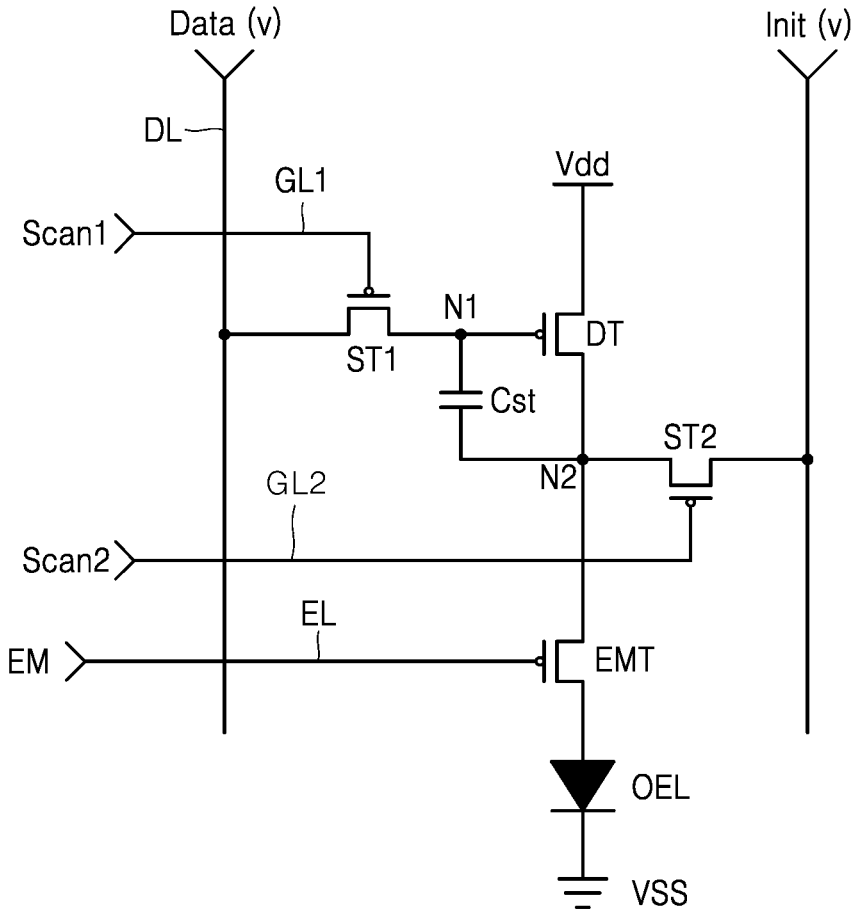
FIG. 2 is a configuration diagram showing one sub-pixel in FIG. 1 in detail according to one or more embodiments of the present disclosure.

FIG. 2 is a configuration diagram showing one sub-pixel in FIG. 1 in detail according to one or more embodiments of the present disclosure.

Referring to FIG. 2, each sub-pixel includes a pixel circuit electrically connected to a first gate line GL1, a second gate line GL2 to control an initialization voltage input, a data line DL, a light emission control line EL, and a light emitting diode OEL electrically connected between the pixel circuit and a low potential power signal VSS and equivalently represented as a diode. It is noted that "GL1" and "GL2" in FIG. 2 may denote any two neighboring gate lines of the image display device, i.e. Gk−1 and Gk where $1<k\leq n$ and "n" being the number of gate lines in the image display device, but do not necessarily refer only to the first gate line GL1 and second gate line GL2 of the gate lines GL1 to Gln of the image display device shown in FIG. 1.

The pixel circuit may be configured as a source follower type compensation circuit and may include a first switching element ST1, a second switching element ST2, a storage capacitor Cst, a driving switching element DT, and a light emitting control element EMT. According to the present disclosure, the pixel circuit is not limited to the source follower type compensation circuit and may be configured as other internal compensation circuits through design-modification.

A driving period of the sub-pixel P may be divided into an initialization period, a sampling period, and a light emission period.

A method of driving each sub-pixel P is described below in detail.

In the sampling period, a first switching element ST1 of the pixel circuit is switched (e.g., turned on) based on a first scan pulse Scan1 applied through the first gate line GL1 to sequentially transmit the sensing data voltage and the image data voltage input through the data line DL to a first node N1 electrically connected to a driving switching element DT. A period for which the first switching element ST1 is turned on is referred to as "a sampling period."

In this case, the second switching element ST2 may receive a second scan signal Scan2 as an initialization signal and may supply an initialization voltage Init (v) input from a data driving circuit 300 or a power supply to a second node electrically connected to each of a driving switching element DT and a light emitting control element EMT in response to the second scan signal Scan 2. Additional gate shift clocks or at least one clock pulse may be received and used as examples of the initialization signals. A period for which the second switching element ST2 is turned on may be referred to as "an initialization period." The initialization period and the sampling period may be overlapped with each other.

In the light emission period, a gate terminal of the driving switching element DT is electrically connected to the first node N1, where the first node N1 is electrically connected to the first switching element ST1, a drain terminal of the driving switching element DT is electrically connected to the second node N2, where the second node N2 is electrically connected to the light emitting control element EMT, and a source terminal (or a driving voltage input terminal) of the driving switching element DT is electrically connected to a high potential voltage source Vdd. The driving switching element DT stores a threshold voltage Vth in a storage capacitor Cst based on the sensing data voltage input through the first switching element ST1 and the initialization voltage Init (v) input through the second switching element ST2. When the image data voltage (Data (v)) is input through the first switching element ST1, the driving switching element DT supplies, to the second node N2 electrically connected to the light emitting control element EMT, a driving voltage having a magnitude corresponding to a magnitude of the image data voltage in which the threshold voltage Vth is compensated.

When the light emitting control signal EM is input through the light emitting control line EL, the light emitting control element EMT supplies, to the light emitting diode OEL, the driving voltage of the second node N2 during that time period and controls the light emitting diode OEL to be emitted.

Figure 3:
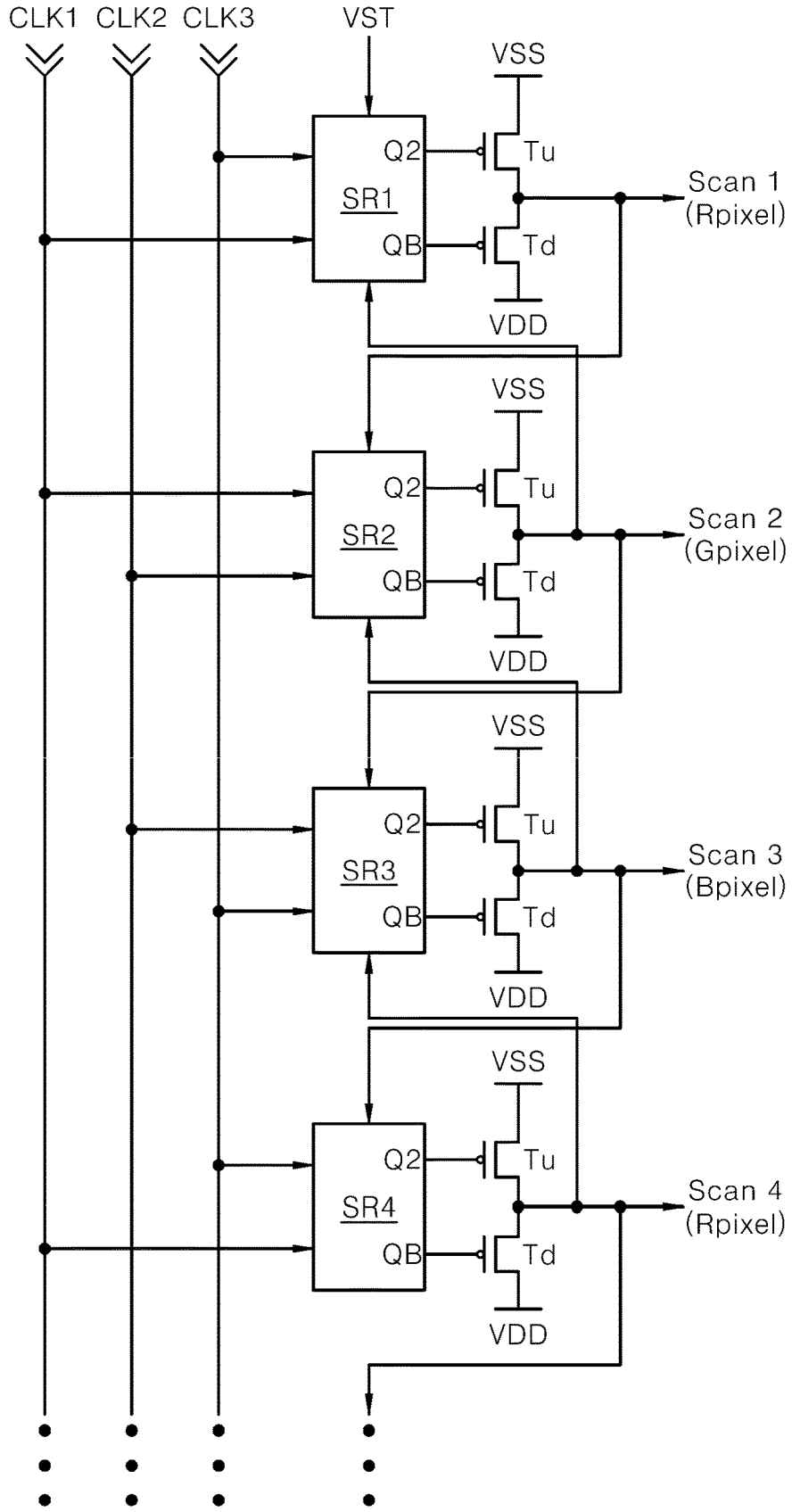
FIG. 3 is a configuration diagram showing the gate driving circuit in FIG. 1 in detail according to one or more embodiments of the present disclosure.

FIG. 3 is a configuration block diagram showing the gate driving circuit in FIG. 1 in detail according to one or more embodiments of the present disclosure.

According to the present disclosure, referring to FIG. 3, a gate driving circuit 200 includes a plurality of stages SR1 to SR4 to sequentially and repeatedly output a plurality of scan pulses having different pulse widths in response to a gate control signal applied from a timing controller 500. Although only the first stage SR1 to the fourth stage SR4 are shown in FIG. 3, a number of stages may be identical to or greater than a number of horizontal lines or gate lines GL1 to GLn of a display panel.

The plurality of stages SR1 to SR4 sequentially generate a plurality of scan pulses Scan 1 to Scan 4 having different pulse widths and phase-delayed in response to three-phase clock pulses CLK1, CLK2, and CLK3 of the gate control signals applied from the timing controller 500 and sequentially transmit the plurality of generated scan pulses Scan1 to Scan 4 to gate lines GL1 to GLn of the display panel 10.

The plurality of scan pulses Scan1 to Scan4 may be output at a low potential voltage level or a high potential voltage level to control an image data voltage input period and a charging period for each sub-pixel. In some cases where the switching elements ST1 and ST2 and the driving switching element DT of each of the sub-pixels are configured as p-channel metal-oxide-semiconductor (PMOS) switching elements ST1 and ST2 and the PMOS driving switching element DT, the plurality of scan pulses Scan1 to Scan 4 output with the low potential voltage level.

Figure 4:
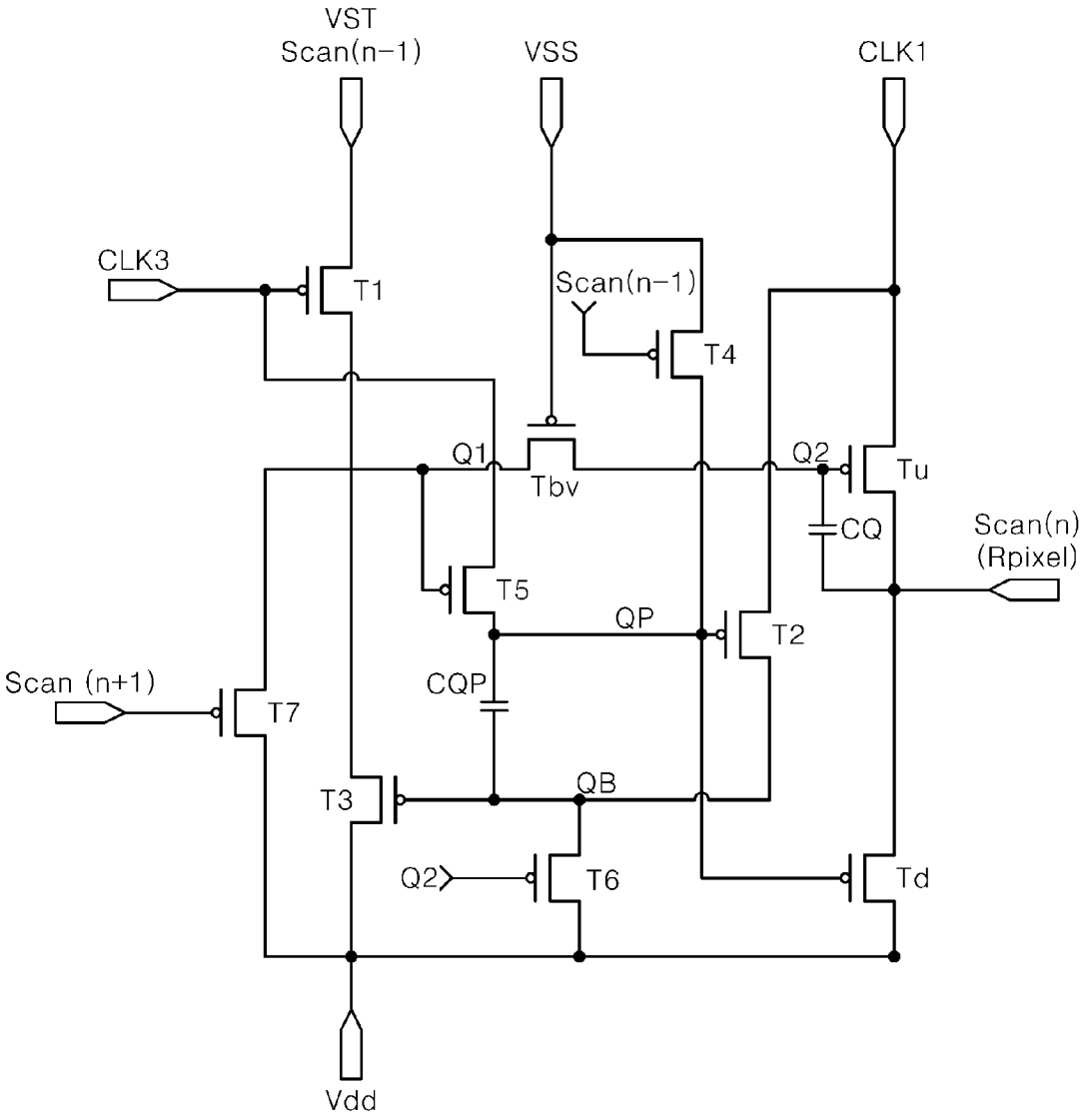
FIG. 4 is a circuit diagram showing a first stage in FIG. 3 in detail according to one or more embodiments of the present disclosure.

At least one of the plurality of stages SR1 to SR4 selectively receives at least one clock pulse among three-phase clock pulses CLK1, CLK2, and CLK3 having different pulse widths and generated repeatedly. Referring to FIGS. 3 and 4, each of the stages receives two clock pulses to be operated.

Each of the stages SR1 to SR4 is enabled in response to one of the three phase clock pulses CLK1, CLK2, and CLK3, which is first received. The stages SR1 to SR4 sequentially output the scan pulses Scan 1 to Scan 4 in response to one clock pulse received in a subsequent sequence.

For example, the first stage SR1 as a first stage is enabled in response to the start pulse VST and the first clock pulse CLK1 applied from the timing controller 500. The first stage SR1 outputs the first scan pulse Scan1 at the low potential voltage level in response to the subsequently-input first clock pulse CLK1. The first scan pulse Scan1 is output at the low potential voltage level during 1 horizontal period of every frame period.

The second stage SR2 receives the first scan pulse Scan1 output from the first stage SR1 as a carry signal. In addition, the second stage SR2 is enabled in response to the first scan pulse Scan1 and the first clock pulse CLK1. Subsequently, the second stage SR2 outputs a second scan pulse Scan 2 at the low potential voltage level in response to the second clock pulse CLK2.

The third stage SR3 receives the second scan pulse Scan2 output from the second stage SR2 as a carry signal. The third stage SR3 is enabled in response to the second scan pulse Scan2 and the second clock pulse CLK2. The third stage SR3 may output a third scan pulse Scan3 at a low potential voltage level in response to the third clock pulse CLK3.

The fourth stage SR4 receives the third scan pulse Scan3 output from the third stage SR3 as a carry signal. The fourth stage SR4 is enabled in response to the third scan pulse Scan3 and the third clock pulse CLK3. The fourth stage SR4 may output a fourth scan pulse Scan4 in response to the first clock pulse CLK1.

The entire stages dependently connected to each other sequentially output a plurality of scan pulses Scan1 to Scan4 during an image display period.

The sub-pixel P of a display panel 10 includes a red sub-pixel (Rpixel), a green sub-pixel (Gpixel), and a blue sub-pixel (Bpixel). At least one (3n−2)th stage (e.g., the first stage SR1) may supply the at least one first scan pulse Scan1 to the red sub-pixel (Rpixel), at least one (3n−1)th stage may supply the at least one second scan pulse Scan2 to the green sub-pixels (Gpixel), and at least one (3n)th stage may supply the at least one third scan pulse Scan3 to the blue sub-pixels (Bpixel), where "n" is a natural number except 0. It should be noted that aforementioned number "n" generally does not coincide with the number "n" of gate lines GL1, . . . , GLn shown in FIG. 1.

FIG. 4 is a circuit diagram showing one stage in FIG. 3 in detail according to one or more embodiments of the present disclosure. It should be noted that the index "n" in "Scan (n−1)", "Scan(n)" and "Scan(n+1)" shown in FIG. 4 generally does not coincide with the number "n" of gate lines GL1, . . . , GLn shown in FIG. 1.

Referring to FIG. 4, each of stages SR1 to SR4 includes a control circuit portion to control an enable state and a disable state of each of a node Q1 and a node Q2 and to control an enable state and a disable state of each of a node QB and a node QP in opposite phases to those of the node Q1 and the node Q2.

Further, each of the stages SR1 to SR4 includes a pull-up switch Tu to output the scan pulse corresponding to the clock pulse of the first clock pulse CLK1 to the third clock pulse CLK3 based on the enable state of each of the node Q1 and the node Q2 and a pull-down switch Td to block an output of the scan pulse based on the enable state of each of the node QB and the node QP.

The control circuit portion of each of the plurality of stages SR1 to SR4 includes a node disconnect switch Tbv to electrically disconnect and connect the node Q1 from and to the node Q2, a first switch T1 to control each of the node Q1 and the node Q2 to be in an enable state, a fourth switch T4 and a fifth switch T5 to control the node QB and the node QP to be in the enable state, a second switch T2 and a sixth switch T6 to control the node QB to be in the disable state, and a third control switch T3 and a seventh control switch T7 to control each of the node Q1 and the node Q2 to be in the disable state. In this case, the sixth switch T6 may be implemented as a double-gate transistor switch.

The node disconnect switch Tbv reduces stress occurring due to continuous voltage supply to the node Q1 and the node Q2 and may electrically connect the node Q1 to the node Q2 in response to a low potential voltage source VSS input in a gate low logic state. The node Q1 and the node Q2 are electrically connected to each other and are electrically disconnected from each other by the node disconnect switch Tbv to reduce the stress applied to the node Q1 and the node Q2 due to the continuous voltage supply.

In some examples, the pull-up switch Tu of each of the stages SR1 to SR4 outputs a scan pulse corresponding to the clock pulse of the first clock pulse CLK1 to the third clock pulse CLK3 based on the enable state of each of the node Q1 and the node Q2. In some case where the node Q1 and the node Q2 are enabled, the pull-up switch Tu outputs, to the gate line, the scan pulse having a pulse width corresponding to a pulse width of the input clock pulse among the first clock pulse CLK1 to the third clock pulse CLK3.

In some cases where the node QB and the node QP are enabled, the pull-down switch Td outputs, to the gate line, an off voltage having a phase opposite to that of the scan pulse and turns off the switching element that receives the scan pulse.

Figure 5:
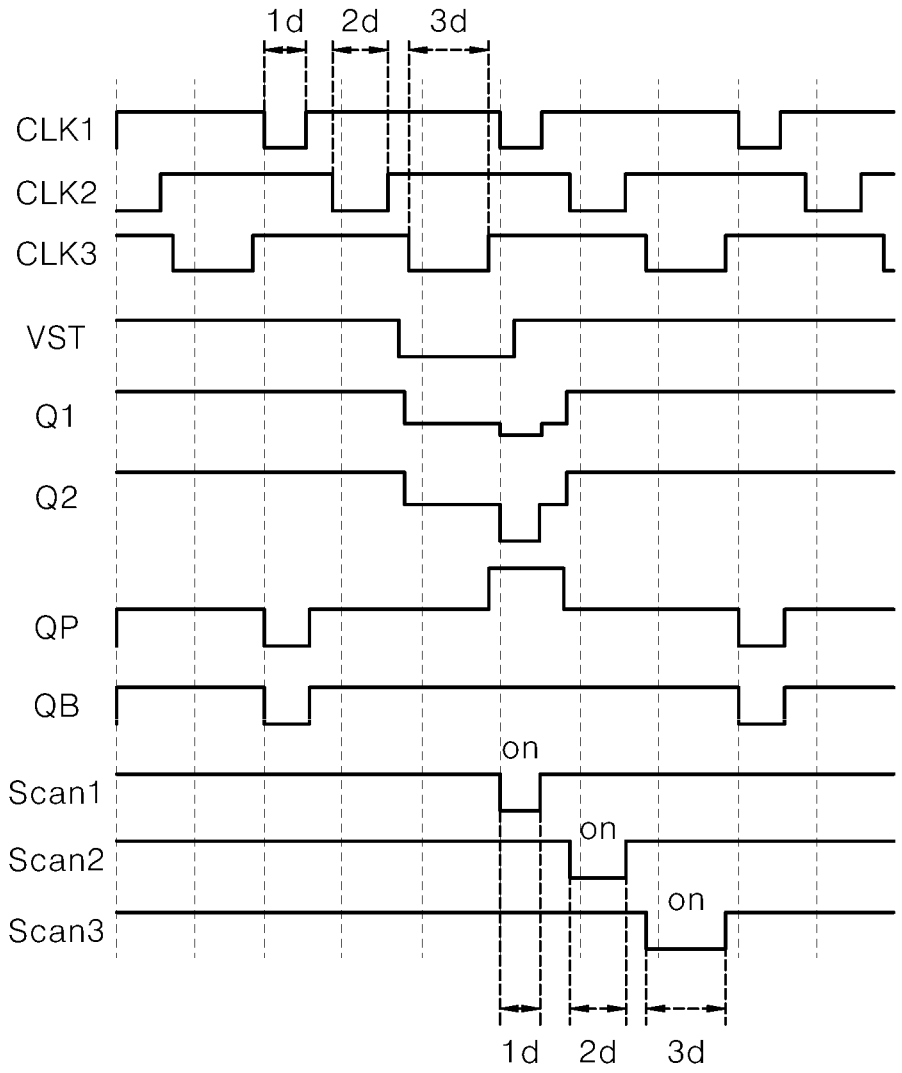
FIG. 5 is a waveform diagram of signals input to and output from a plurality of stages shown in FIG. 3 according to one or more embodiments of the present disclosure.

FIG. 5 is a waveform diagram of signals input to and output from a plurality of stages shown in FIG. 3 according to one or more embodiments of the present disclosure.

Referring to FIG. 5, a second clock pulse CLK2 has a pulse width 2*d* wider than a pulse width 1*d* of a first clock pulse CLK1 and a third clock pulse CLK3 has a pulse width 3*d* wider than the pulse width 2*d* of the second clock pulse CLK2 and each of the first clock pulse CLK1 to the third clock pulse CLK3 sequentially output may be supplied to the plurality of stages SR1 to SR4.

Each of the plurality of red sub-pixels, green sub-pixels, and blue sub-pixels P is repeatedly arranged in sequence. At least one (3n−2)th stage (e.g., a first stage SR1) supplies at least one first scan pulse Scan1 to the red sub-pixels (Rpixel) in response to the at least one first clock pulse CLK1. At least one (3n−1)th stage may supply the at least one second scan pulse Scan2 to the green sub-pixels (Gpixel) in response to the at least one second clock pulse CLK2. At least one (3n)th stage may supply the at least one third scan pulse Scan3 to the blue sub-pixels (Bpixel) in response to the at least one third clock pulse CLK3.

The sub-pixels have different initialization periods and sampling periods to improve image quality of a display panel. In some examples, an image data voltage charging period and a charging rate of the green sub-pixels (Gpixel) having a greater grayscale voltage difference than that of the red sub-pixels (Rpixel) may be increased and a charging period (e.g., the sampling period) and a charging rate (e.g., a rate at which the data voltage is charged in a storage capacitor Cst) of the blue sub-pixels (Bpixel) having a greatest image data voltage value than that of the green sub-pixels (Gpixel) may be increased.

Referring to FIGS. 4 and 5, the first switch T1 is turned on based on a gate start signal VST, a scan signal output from a previous terminal stage, and a clock pulse CLK3 input to the previous terminal stage to control each of the node Q1 and the node Q2 to be in an enable state. The first stage SR1 is controlled to be in the enable state based on the gate start signal VST and the third clock pulse CLK3 and the stages except for the first stage SR1 are controlled to be in the enable state based on the scan signal Scan1 output from the previous terminal stage and at least one clock pulse also input to the previous terminal stage (e.g., at least one of the clock pulses CLK1 to CLK3).

In this case, the node disconnect switch Tbv electrically connects the node Q1 to the node Q2 in response to a low potential voltage source VSS or a gate low voltage VGL. The node Q1 and the node Q2 may each be bootstrapped by a first storage capacitor CQ.

The fifth switch T5 is turned on based on the enable voltage of the node Q1 to charge a first compensation capacitor CQP during an enable period of the node Q1. The first compensation capacitor CQP bootstraps the node QP to stabilize the disable state of the node QB during discharge.

Subsequently, when the node Q1 and the node Q2 are each changed to be in the enable state by each of the first switch T1 and the node disconnect switch Tbv, the pull-up switch Tu outputs the scan pulse corresponding to one clock pulse of the first clock pulse CLK1 to the third clock pulse CLK3 based on the enable state of each of the node Q1 and the node Q2. For example, the pull-up switch Tu of the first stage SR1 outputs the first scan pulse Scan1 corresponding to the first clock pulse CLK1 based on the enable state of each of the node Q1 and the node Q2.

In some examples, the second switch T2 and a sixth switch T6 each maintain the node QB to be in the disable state during the enable period of each of the node Q1 and the node Q2.

A seventh control switch T7 is turned on based on a scan pulse Scan (n+1) output from a subsequent terminal or at least one clock pulse CLK2 input to the next terminal stage to control the node Q1 and the node Q2 to be in the disable state, the fourth switch T4 and the fifth switch T5 each control the node QB and the node QP to be in the enable state. In this case, the pull-down switch Td of the first stage SR1 is turned on based on the enable state of each of the node QB and the node QP to block the output of the first scan pulse Scan 1.

The control circuit portion of the second stage SR2 also sequentially controls the enable state and the disable state of each of the node Q1 and the node Q2 and controls the enable state and the disable state of each of the node QB and the node QP in the opposite phase to those of the node Q1 and the node Q2 through the same driving method. The pull-up switch Tu of the second stage SR2 outputs a second scan pulse Scan2 corresponding to the second clock pulse CLK2 based on to the enable state of each of the node Q1 and the node Q2. The pull-down switch Td of the second stage SR2 blocks the output of the second scan pulse Scan2 based on the enable state of each of the node QB and the node QP.

Subsequently, the control circuit portion of the third stage SR3 also sequentially controls the enable state and the disable state of each of the node Q1 and the node Q2 and also controls the enable state and the disable state of each of the node QB and the node QP in the opposite phases to those of the node Q1 and the node Q2. The pull-up switch Tu of the third stage SR3 outputs a third scan pulse Scan3 corresponding to the third clock pulse CLK3 based on the enable state of each of the node Q1 and the node Q2. The pull-down switch Td of the third stage SR3 also blocks the output of the third scan pulse Scan3 based on the enable state of each of the node QB and the node QP.

In the operation sequence, at least one (3n−2)th stage (e.g., the first stage SR1) outputs the at least one first scan pulse Scan1 only during a period of time for which the at least one first clock pulse is input to the at least one (3n−2)th stage. Therefore, the first clock pulse has a pulse width identical to that of the first scan pulse. The at least one (3n−2)th stage also supplies the first scan pulse Scan1 to the red sub-pixels (Rpixel). The at least one (3n−1)th stage outputs the at least one second scan pulse Scan2 only during a period of time for which the at least one second clock pulse is input to the at least one (3n−1)th stage. Therefore, the second clock pulse has a pulse width identical to that of the second scan pulse. The at least one (3n−1)th stage also supplies the second scan pulse Scan 2 to the green sub-pixels (Gpixel). The at least one (3n)th stage outputs the at least one third scan pulse Scan3 only during a period of time for which the at least one third clock pulse is input to the at least one (3n)th stage. Therefore, the third clock pulse has a pulse width identical to that of the third scan pulse. The at least one (3n)th stage also supplies the third scan pulse Scan 3 to the blue sub-pixels (Bpixel). In some cases where the first clock pulse CLK1, the second clock pulse CLK2, and the third clock pulse CLK3 have the different widths, the widths of the first scan pulse Scan1, the second scan pulse Scan 2, and the third scan pulse Scan3 are also output differently.

Figure 6:
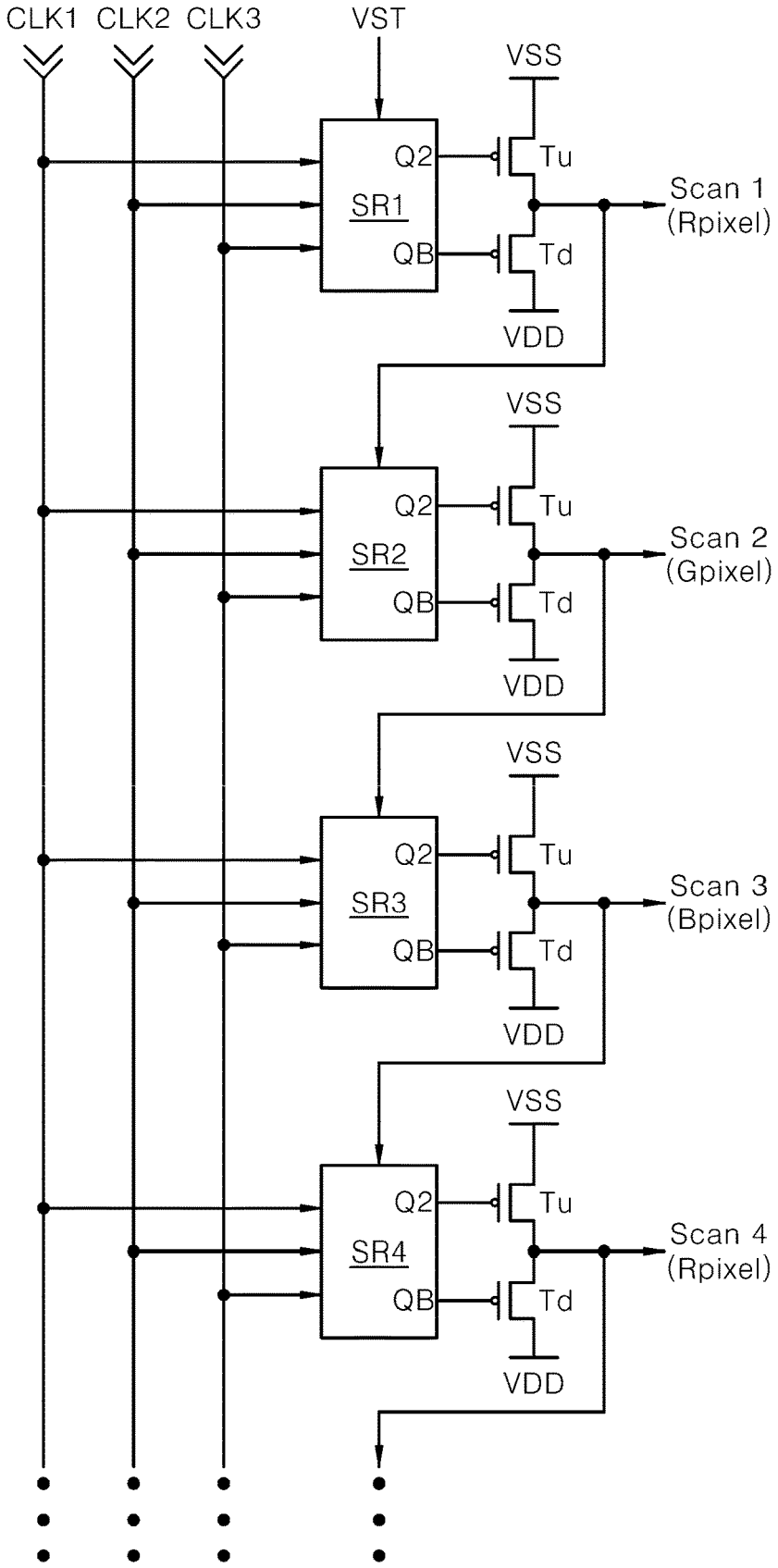
FIG. 6 is another configuration block diagram showing the gate driving circuit in FIG. 1 in detail according to one or more embodiments of the present disclosure.

FIG. 6 is another configuration block diagram showing the gate driving circuit in FIG. 1 in detail according to one or more embodiments of the present disclosure.

Referring to FIG. 6, a plurality of stages SR1 to SR4 sequentially generate a plurality of scan pulses Scan 1 to Scan 4 having different pulse widths and phase-delayed in response to three-phase clock pulses CLK1, CLK2, and CLK3 among the gate control signals applied from a timing controller 500 and sequentially transmit the plurality of generated scan pulses Scan 1 to Scan 4 to gate lines GL1 to GLn of a display panel 10.

The plurality of stages SR1 to SR4 may receive all three-phase clock pulses CLK1, CLK2, and CLK3 having different pulse widths and repeatedly generated. The plurality of stages SR1 to SR4 may sequentially output the scan pulses Scan 1 to Scan 4, respectively, during time periods corresponding to the time periods for which the clock pulses are input in response to the three-phase clock pulses CLK1, CLK2, and CLK3 sequentially.

In some examples, each of the stages SR1 to SR4 shown in FIG. 6 simultaneously receives the clock pulse input to the previous terminal stage (e.g., VST in the case of the first stage) to be in the enable state and outputs a scan pulse in response to one clock pulse input subsequently (e.g., one of CLK1, CLK2, and CLK3). Each of the stages SR1 to SR4 simultaneously receives the clock pulse supplied to the next terminal stage to output the scan pulse to change the state thereof to be in the disable state.

For example, the first stage SR1 outputs the first scan pulse Scan 1 at a low potential voltage level in response to a start pulse VST and the first clock pulse CLK1 applied from the timing controller 500. The first scan pulse Scan 1 is output at the low potential voltage level for 1 horizontal period of every frame period. The first stage SR1 simultaneously receives the second clock pulse CLK2 supplied to the second stage SR2 to output the second scan pulse Scan 2 of the second stage SR2 as a subsequent terminal and is disabled based on the second clock pulse CLK2.

The second stage SR2 simultaneously receives, as a carry signal, the first clock pulse CLK1 supplied to the first stage SR1 as a previous terminal to output the first scan pulse Scan 1 by the first stage SR1. When the second clock pulse CLK2 is input to the second stage SR2, the second stage SR2 outputs the second scan pulse Scan 2 at a low potential voltage level. The second stage SR2 simultaneously receives the third clock pulse CLK3 supplied to the third stage SR3 to output the third scan pulse Scan 3 by the third stage SR3 and is disabled based on the third clock pulse CLK3.

The third stage SR3 simultaneously receives, as a carry signal, the second clock pulse CLK2 supplied to the second stage SR2 to output the second scan pulse Scan 2 by the second stage SR2 as the previous stage. When the third clock pulse CLK3 is input, the third stage SR3 outputs the third scan pulse Scan 3 at a low potential voltage level. Subsequently, the third stage SR3 simultaneously receives the first clock pulse CLK1 supplied to the fourth stage SR2 to output the fourth scan pulse Scan 4 by the fourth stage SR2 and is disabled based on the first clock pulse CLK1.

In some examples, the third clock pulse CLK3 among the first clock pulse CLK1, the second clock pulse CLK2, and third clock pulse CLK3 has the pulse width 3*d* wider than a pulse width 1*d* of the first clock pulse CLK1.

The second clock pulse CLK2 has a pulse width 2*d* wider than a pulse width 3*d* of the third clock pulse CLK3 such that each of the first clock pulse CLK1 to the third clock pulse CLK3 are supplied to one of the plurality of stages SR1 to SR4.

As the sub-pixels P may be disposed in the display panel 10 to implement the TRD display panel 10, at least one (3n−2)th stage (e.g., the first stage SR1) may supply the at least one first scan pulse Scan 1 to the red sub-pixels (Rpixel) and the at least one (3n−2)th stage may supply the at least one second scan pulse Scan 2 to the green sub-pixels (Gpixel), and at least one (3n)th stage may supply the at least one third scan pulse Scan 3 to the blue sub-pixels (Bpixel).

Therefore, a charging period and a charging rate of the blue sub-pixels (Bpixel) having a greater image data voltage value than that of the red sub-pixels (Rpixel) may be increased and an image data charge period (e.g., a sampling period) and a charging rate (a charging rate of a data voltage in a storage capacitor Cst) of the green sub-pixels (Gpixel) having a greater grayscale voltage difference that that of the blue sub-pixels (Bpixel) may be increased.

Figure 7:
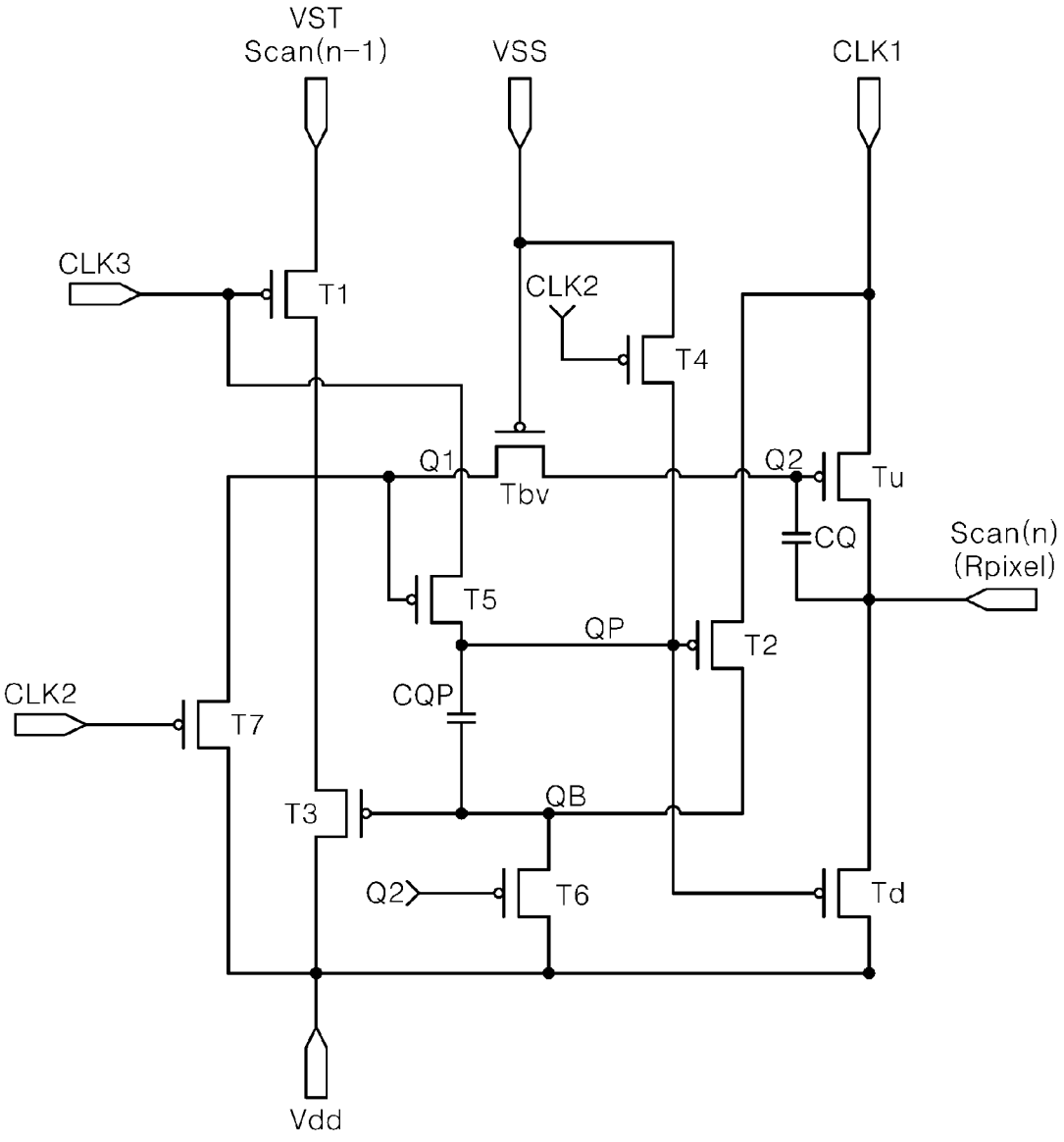
FIG. 7 is another circuit diagram showing a first stage in FIG. 6 in detail according to one or more embodiments of the present disclosure.

FIG. 7 is another circuit diagram showing the first stage in FIG. 6 in detail according to one or more embodiments of the present disclosure. It should be noted that, similarly as with FIG. 4, the index "n" in "Scan(n−1)" and "Scan(n)" shown in FIG. 7 generally does not coincide with the number "n" of gate lines GL1, . . . , GLn shown in FIG. 1.

Referring to FIGS. 6 and 7, the first switch T1 is turned on based on the gate start signal VST and the third clock pulse CLK3, which is a clock pulse input to the previous terminal, to control each of the node Q1 and the node Q2 to be in an enable state.

In this case, a node disconnect switch Tbv electrically connects the node Q1 to the node Q2 in response to the low potential voltage source VSS or the gate low voltage VGL. The node Q1 and the node Q2 may each be bootstrapped by the first storage capacitor CQ.

The fifth switch T5 is turned on based on the enable voltage of the node Q1 to charge a first compensation capacitor CQP during an enable period of the node Q1.

Subsequently, when the node Q1 and the node Q2 are each changed to be in the enable state by each of the first switch T1 and the node disconnect switch Tbv, the pull-up switch Tu outputs the scan pulse corresponding to the clock pulse of the first clock pulse CLK1 to the third clock pulse CLK3 based on the enable states of the node Q1 and the node Q2. For example, the pull-up switch Tu of the first stage SR1 outputs a first scan pulse Scan 1 corresponding to the first clock pulse CLK1 based on the enable states of the node Q1 and the node Q2.

In some examples, each of the second switch T2 and the sixth switch T6 maintains the node QB to be in a disable state during the enable periods of the node Q1 and the node Q2.

When the third control switch T3 and a seventh control switch T7 are turned on based on the clock pulse CLK3 input to the previous terminal to control each of the node Q1 and the node Q2 to be in the disable state, the fourth switch T4 and the fifth switch T5 each control the node QB and the node QP to be in the enable state. In this case, the pull-down switch Td of the first stage SR1 blocks the output of the first scan pulse Scan 1 based on the enable state of each of the node QB and the node QP.

A control circuit portion of the second stage SR2 also sequentially controls the enable state and disable state of each of the node Q1 and the node Q2 and controls the enable state and the disable state of each of the node QB and the node QP in opposite phases to those of the node Q1 and the node Q2 through the same driving method. The pull-up switch Tu of the second stage SR2 outputs a second scan pulse Scan 2 corresponding to the second clock pulse CLK2 based on the enable state of each of the node Q1 and the node Q2. The pull-down switch Td of the second stage SR2 also blocks the output of the second scan pulse Scan 2 based on the enable state of each of the node QB and the node QP.

The control circuit portion of the third stage SR3 also sequentially controls the enable state and the disable state of each of the node Q1 and the node Q2 and controls the enable state and the disable state of each of the node QB and the node QP having opposite phases to those of the node Q1 and the node Q2. The pull-up switch Tu of the third stage SR3 outputs a third scan pulse Scan 3 corresponding to the third clock pulse CLK3 based on the enable state of each of the node Q1 and the node Q2. The pull-down switch Td of the third stage SR3 also blocks the output of the third scan pulse Scan 3 based on the enable state of each of the node QB and the node QP.

In the operation sequence, the at least one (3n−2)th stage (e.g., the first stage SR1) may output the at least one first scan pulse Scan 1 only during a period of time for which the at least one first clock pulse CLK1 is input to the at least one (3n−2)th stage. Therefore, the first clock pulse CLK1 has a pulse width identical to that of the first scan pulse Scan 1. The at least one (3n−2)th stage also supplies the first scan pulse Scan 1 to the red sub-pixels (Rpixel). The at least one (3n−1)th stage may output the at least one second scan pulse Scan 2 only during a period of time for which the at least one second clock pulse CLK2 is input to the at least one (3n−1)th stage. Therefore, the second clock pulse CLK2 has a pulse width identical to that of the second scan pulse. The at least one (3n−1)th stage supplies the second scan pulse to the green sub-pixels (Gpixel). The at least one (3n)th stage may output the at least one third scan pulse Scan 3 only during a period of time for which the at least one third clock pulse is input to the at least one (3n)th stage. Therefore, the third clock pulse CLK3 has a pulse width identical to that of the third scan pulse. The least one (3n)th stage supplies the third scan pulse Scan 3 to the blue sub-pixels (Bpixel).

As a result, the charging period and the charging rate of blue sub-pixels (Bpixel) having a greater image data voltage value than that of the red sub-pixels (Rpixel) may be increased and an image data voltage charging period and a charging rate of a green sub-pixels (Gpixel) having a greater grayscale voltage than that of the blue sub-pixels (Bpixel) may be further increased.

The aspects of the present disclosure can also be described as follows.

According to an aspect of the present disclosure, there is provided a gate driving circuit. The gate driving circuit comprises a plurality of stages configured to sequentially and repeatedly output a plurality of scan pulse signals. Each has a different pulse width in response to at least one external gate control signal. The external gate control signal includes three-phase clock pulses. At least one of the plurality of stages is configured to sequentially generate at least one of the plurality of scan pulse signals having the different pulse width and phase-delayed in response to the three-phase clock pulses among the gate control signals. The pulse width for each of the scan pulse signals and a phase delay for each of the scan pulse signals determined based on the three-phase clock pulses, and the plurality of stages is configured to supply the plurality of scan pulse signals to a plurality of gate lines of a display panel in the sequence.

The three-phase clock pulses may include a first clock pulse signal, a second clock pulse signal, and a third clock pulse signal that are generated sequentially, the second clock pulse signal may have a pulse width that is wider than a pulse width of the first clock pulse signal, the third clock pulse signal may have a pulse width that is wider than the pulse width of the second clock pulse signal, and the first clock pulse signal, the second clock pulse signal, and the third clock pulse signal may be sequentially and alternately supplied to the plurality of stages. At least one (3n−2)th stage in the plurality of stages may be configured to supply at least the first scan pulse signal to red sub-pixels of the display panel in response to the at least the first clock pulse signal, at least one (3n−1)th stage in the plurality of stages may be configured to supply at least the second scan pulse signal to green sub-pixels of the display panel in response to the at least the second clock pulse signal, and at least one (3n)th stage in the plurality of stages may be configured to supply at least the third scan pulse signal to blue sub-pixels of the display panel in response to the at least the third clock pulse signal. "n" is a natural number except 0.

Each of the stages may include a control circuit portion configured to control an enable state and a disable state for each of a node Q1 and a node Q2 and to control an enable state and a disable state for each of a node QB and a node QP with phases that are opposite to phases of the node Q1 and the node Q2, a pull-up switch configured to output the scan pulse signal corresponding to one of a first clock pulse signal, a second clock pulse signal, and a third clock pulse signal based on the enable state of each of the node Q1 and the node Q2, and a pull-down switch configured to block the output of the scan pulse signal based on the enable state of each of the node QB and the node QP. The control circuit portion may include a first switch, a second switch, a third switch, a fourth switch, a fifth switch, a sixth switch, and a seventh switch. The first switch may be turned on based on a gate start signal, a clock pulse signal, or a dummy clock pulse signal applied to a previous terminal to control the node Q1 and node Q2 to be in an enable state. The fifth switch may be turned on based on an enable voltage of the node Q1 to charge a first compensation capacitor during an enable period of the node Q1. The second switch and the sixth switch may be configured to maintain the node QB to be in the disable state during the enable period of each of the node Q1 and the node Q2. And the third switch and the seventh switch may be turned on based on the scan pulse signal output from a subsequent terminal or the clock pulse signal applied to the subsequent terminal to control the node Q1 and the node Q2 to be in the disable state. The fourth switch may be configured to control the node QB and the node QP to be in the enable state.

According to an aspect of the present disclosure, an image display device comprises a display panel with red sub-pixels, green sub-pixels, and blue sub-pixels in a plurality of pixel areas and configured to display an image, a data driving circuit configured to drive data lines of the display panel, a gate driving circuit configured to sequentially and repeatedly supply a plurality of scan pulses having different pulse widths to gate lines of the display panel, and a timing controller configured to generate a plurality of gate control signals having different pulse widths to supply the plurality of gate control signals to the gate driving circuit and to control a driving timing of each of the gate driving circuit and the data driving circuit.

The timing controller may be configured to sequentially and repeatedly generate three-phase clock pulses with different pulse widths. And the timing controller may be configured to supply the gate control signals to the gate driving circuit. The gate control signals may include the three-phase clock pulses having the different pulse widths.

Embodiments of the present disclosure have been described in more detail with reference to the accompanying drawings, but the present disclosure is not necessarily limited to these embodiments, and can be variously modified without departing from the present disclosure. Therefore, the embodiments disclosed in the present disclosure are not intended to limit the present disclosure, but to explain, and the scope of the present disclosure is not limited by these embodiments. Therefore, it should be understood that the embodiments described above are illustrative in all respects and not restrictive. The scope of protection of the present disclosure should be interpreted by the claims.

Other embodiments are within the scope of the following claims.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A gate driving circuit, comprising:

a plurality of stages configured to sequentially and repeatedly output a plurality of scan pulse signals, each having a different pulse width in response to at least one external gate control signal, the external gate control signal including three-phase clock pulses, and a timing controller configured to generate the three-phase clock pulses and supply the gate control signals to the plurality of stages, wherein at least one of the plurality of stages is configured to sequentially generate at least one of the plurality of scan pulse signals having the different pulse width and phase-delayed in response to the three-phase clock pulses among the gate control signals, the pulse width for each of the scan pulse signals and a phase delay for each of the scan pulse signals determined based on the three-phase clock pulses, wherein the plurality of stages is configured to supply the plurality of scan pulse signals to a plurality of gate lines of a display panel in the sequence, and wherein the timing controller is configured to sequentially and repeatedly generate the three-phase clock pulses with different pulse widths.

2. The gate driving circuit of claim 1, wherein the three-phase clock pulses include a first clock pulse signal, a second clock pulse signal, and a third clock pulse signal that are generated sequentially, wherein the second clock pulse signal has a pulse width that is wider than a pulse width of the first clock pulse signal, wherein the third clock pulse signal has a pulse width that is wider than the pulse width of the second clock pulse signal, and wherein the first clock pulse signal, the second clock pulse signal, and the third clock pulse signal are sequentially and alternately supplied to the plurality of stages.

3. The gate driving circuit of claim 2, wherein at least one (3n−2)th stage in the plurality of stages is configured to supply at least the first scan pulse signal to red sub-pixels of the display panel in response to the at least the first clock pulse signal, wherein at least one (3n−1)th stage in the plurality of stages is configured to supply at least the second scan pulse signal to green sub-pixels of the display panel in response to the at least the second clock pulse signal, and wherein at least one (3n)th stage in the plurality of stages is configured to supply at least the third scan pulse signal to blue sub-pixels of the display panel in response to the at least the third clock pulse signal, wherein n is a natural number except 0.

4. The gate driving circuit of claim 1, wherein the three-phase clock pulses include a first clock pulse signal, a second clock pulse signal, and a third clock pulse signal that are generated sequentially, wherein the third clock pulse signal has a pulse width that is wider than a pulse width of the first clock pulse signal, wherein the second clock pulse signal has a pulse width that is wider than the pulse width of the third clock pulse signal, and wherein the first clock pulse signal, the second clock pulse signal, and the third clock pulse signal are sequentially and alternately supplied to the plurality of stages.

5. The gate driving circuit of claim 4, wherein at least one (3n−2)th stage in the plurality of stages is configured to supply at least the first scan pulse signal to red sub-pixels of the display panel in response to the at least the first clock pulse signal, wherein at least one (3n−1)th stage in the plurality of stages is configured to supply at least the second scan pulse signal to green sub-pixels of the display panel in response to the at least the second clock pulse signal, and wherein at least one (3n)th stage in the plurality of stages is configured to supply at least the third scan pulse signal to blue sub-pixels of the display panel in response to the at least the third clock pulse signal.

6. The gate driving circuit of claim 1, wherein each of the stages includes:

a control circuit portion configured to control an enable state and a disable state for each of a node Q1 and a node Q2 and to control an enable state and a disable state for each of a node QB and a node QP with phases that are opposite to phases of the node Q1 and the node Q2;

a pull-up switch configured to output the scan pulse signal corresponding to one of a first clock pulse signal, a second clock pulse signal, and a third clock pulse signal based on the enable state of each of the node Q1 and the node Q2; and a pull-down switch configured to block the output of the scan pulse signal based on the enable state of each of the node QB and the node QP.

7. The gate driving circuit of claim 6, wherein the control circuit portion includes a first switch, a second switch, a third switch, a fourth switch, a fifth switch, a sixth switch, and a seventh switch, wherein the first switch is turned on based on a gate start signal, a clock pulse signal, or a dummy clock pulse signal applied to a previous terminal to control the node Q1 and node Q2 to be in an enable state, wherein the fifth switch is turned on based on an enable voltage of the node Q1 to charge a first compensation capacitor during an enable period of the node Q1, wherein the second switch and the sixth switch are configured to maintain the node QB to be in the disable state during the enable period of each of the node Q1 and the node Q2, and wherein, when the third switch and the seventh switch are turned on based on the scan pulse signal output from a subsequent terminal or the clock pulse signal applied to the subsequent terminal to control the node Q1 and the node Q2 to be in the disable state, the fourth switch is configured to control the node QB and the node QP to be in the enable state.

8. An image display device, comprising:

a display panel with red sub-pixels, green sub-pixels, and blue sub-pixels in a plurality of pixel areas and configured to display an image;

a data driving circuit configured to drive data lines of the display panel;

a gate driving circuit configured to sequentially and repeatedly supply a plurality of scan pulses having different pulse widths to gate lines of the display panel; and a timing controller configured to generate a plurality of gate control signals having different pulse widths to supply the plurality of gate control signals to the gate driving circuit and to control a driving timing of each of the gate driving circuit and the data driving circuit, wherein the gate driving circuit includes a plurality of stages configured to output the plurality of scan pulses in response to the gate control signals including three-phase clock pulses, wherein the timing controller is configured to sequentially and repeatedly generate the three-phase clock pulses with different pulse widths.

9. The image display device of claim 8, wherein the plurality of stages are configured to sequentially generate the plurality of scan pulses having different phase widths with phase delays in response to the three-phase clock pulses, and wherein the plurality of stages is configured to sequentially supply the plurality of scan pulses to the gate lines of the display panel.

10. The image display device of claim 9, wherein each of the stages include:

a control circuit portion configured to control an enable state and a disable state of each of a node Q1 and a node Q2 and to control an enable state and a disable state of each of a node QB and a node QP in opposite phases to phases of the node Q1 and the node Q2;

a pull-up switch configured to output the scan pulse corresponding to one of a first clock pulse, a second clock pulse, and a third clock pulse based on the enable state of each of the node Q1 and the node Q2; and a pull-down switch configured to block the output of the scan pulse based on the enable state of each of the node QB and the node QP.

11. The image display device of claim 10, wherein the control circuit portion includes a first switch, a second switch, a third switch, a fourth switch, a fifth switch, a sixth switch, and a seventh switch, wherein the first switch is turned on based on a gate start signal and a clock pulse or dummy clock pulse applied to a previous terminal to control the node Q1 and the node Q2 to be in the enable state, wherein the fifth switch is turned on based on an enable voltage of the node Q1 to charge a first compensation capacitor during an enable period of the node Q1, wherein the second switch and the sixth switch are configured to maintain the node QB to be in the disable state during the enable period of each of the node Q1 and the node Q2, and wherein, when the third switch and the seventh switch are turned on based on the scan pulse output from a subsequent terminal or the clock pulse applied to the subsequent terminal to control the node Q1 and the node Q2 to be in the disable state, the fourth switch is configured to control the node QB and the node QP to be in the enable state.

12. The image display device of claim 8, wherein the three-phase clock pulses include a first clock pulse, a second clock pulse, and a third clock pulse that are generated sequentially, and wherein the second clock pulse has a pulse width that is wider than a pulse width of the first clock pulse, wherein the third clock pulse has a pulse width that is wider than the pulse width of the second clock pulse, and wherein the first clock pulse, the second clock pulse, and the third clock pulse are configured to be sequentially and alternately supplied to the plurality of stages.

13. The image display device of claim 12, wherein at least one (3n−2)th stage in the plurality of stages is configured to supply at least the first scan pulse to red sub-pixels of the display panel in response to the at least the first clock pulse, wherein at least one (3n−1)th stage in the plurality of stages is configured to supply at least the second scan pulse to the green sub-pixels of the display panel in response to the at least the second clock pulse, and wherein at least one (3n)th stage in the plurality of stages is configured to supply at least the third scan pulse to blue sub-pixels of the display panel in response to the at least the third clock pulse.

14. The image display device of claim 8, wherein the three-phase clock pulses include a first clock pulse, a second clock pulse, a third clock pulse that are generated sequentially, wherein the third clock pulse has a pulse width that is wider than a pulse width of the first clock pulse, wherein the second clock pulse has a pulse width that is wider than the pulse width of the third clock pulse, and wherein the first clock pulse, the second clock pulse, and the third clock pulse are sequentially and alternately supplied to the plurality of stages.

15. The image display device of claim 14, wherein at least one (3n−2)th stage in the plurality of stages is configured to supply at least the first scan pulse to red sub-pixels of the display panel in response to the at least the first clock pulse, wherein at least one (3n−1)th stage in the plurality of stages is configured to supply at least the second scan pulse to the green sub-pixels of the display panel in response to the at least the second clock pulse, and wherein at least one (3n)th stage in the plurality of stages is configured to supply at least the third scan pulse to blue sub-pixels of the display panel in response to the at least the third clock pulse.

* * * * *